US005099731A

United States Patent [19]

Eigenmann

[11] Patent Number: 5,099,731

[45] Date of Patent: Mar. 31, 1992

[54] MULTI-STROKE PUNCH PRESS WITH A MEANS FOR CORRECTING THE IMMERSION DEPTH AND THE LENGTH OF FEED

[75] Inventor: Oskar Eigenmann, Arbon, Switzerland

[73] Assignee: Bruderer AG, Frasnacht, Switzerland

[21] Appl. No.: 450,285

[22] Filed: Dec. 11, 1989

[51] Int. Cl.[5] ..... B26D 5/00

[52] U.S. Cl. ..... 83/74; 83/72; 83/75

[58] Field of Search ..... 83/72, 74, 75

[56] References Cited

U.S. PATENT DOCUMENTS 4,534,249 8/1985 Smith ..... 83/74
4,823,658 4/1989 Spicer ..... 83/74

FOREIGN PATENT DOCUMENTS 84271 7/1989 European Pat. Off. .
3432235 3/1980 Fed. Rep. of Germany .
2731084 7/1980 Fed. Rep. of Germany .
2396641 2/1979 France .
1099192 1/1968 United Kingdom .

OTHER PUBLICATIONS

"Stanzereitechnik", Hoffman, H., pp. 269-273, article.

*Primary Examiner*—W. Donald Gray
*Attorney, Agent, or Firm*—Ladas & Parry

[57] ABSTRACT

A punch press, which is controllable by a control apparatus according to a design characteristic curve for the depth of immersion as function of the number of strokes, is provided with a control input, by means of which a correcting value can be inputted. The punch press operates then at a new point of operation. At a change of the number of strokes, the control apparatus computes with the correcting value and the present design characteristic curve a new design characteristic curve. Such punch press allows the production of punched and embossed products at a higher precision within the entire range of number of strokes.

8 Claims, 4 Drawing Sheets

MULTI-STROKE PUNCH PRESS WITH A MEANS FOR CORRECTING THE IMMERSION DEPTH AND THE LENGTH OF FEED

BACKGROUND OF THE INVENTION

1. Field of the Invention

The present invention relates to a multi-stroke punch press designed to operate at an adjustably variable rate of strokes and including a control apparatus provided with a design characteristic curve and which is operative to produce signals depending from the design characteristic curve for an adjusting apparatus which is operative to set the depth of immersion of the punch of the punch press depending from the signals emitted from the control apparatus while the punch press is operating.

The invention further relates to a multi-stroke punch press designed to operate at an adjustably variable rate of strokes and having a control apparatus which is provided with a design characteristic curve and is operative to produce signals depending from the design characteristic curve for an adjusting apparatus which is operative to set the feeding length of the material to be punched depending from the signals emitted from the control apparatus while the punch press is operating.

Changes of parameters in the operation of punch presses, such as rate of strokes, variety of tools or work and type of pieces, always cause deviations from preset design values. For one example, changing the rate of the strokes changes the mass forces change, i.e., the mass forces increase along with an increasing rate of strokes. Such leads to small elastic changes in the dimensions of moving parts of the punch press, changes in the plays or clearances of bearings, and changes of the height of the tool closure and immersion depth of the tools. For another example, various tools which deviate relative to each other in respect of their mass also cause different moments of inertia in operation. These inertias can add themselves to the previously mentioned mass forces or inertias, and accordingly, to further deviations from the preset design values. For another example, particularly with regard to the immersion depth, the characteristics of a work piece to be processed, such as for instance its metallurgical characteristic or the shape of the product to be produced, have an influence.

Deviations from design values occur also in the feeding apparatus where the measure of the length of feed deviates from a respective preset design value, whereby in this instance an increasing number of strokes and the mass of the web being accelerated cause further errors.

2. Description of the Prior Art

The German Patent Specification DE-27 31 084 discloses a punch press in which the immersion depth of the punch or tool can be adjusted while the punch press is in operation via a control apparatus. A design characteristic curve is set in the mentioned control apparatus. The curve shall represents the immersion depth as a function of the number of strokes per minute of the punch press. This characteristic curve is taken as design value. The value of the immersion depth is measured and compared with this design value. In case of a deviation of the actual value, an adjustment towards the design value is produced by such control apparatus.

Practical operation has, however, revealed that such a control does not always lead to satisfactory results. The reason is that the actual values of operation of such a press are subject to complex changes over the entire range of the rate of strokes, which will be explained in detail further below. As a result, the mentioned control apparatus can oftentimes not supply satisfactory results over the entire range of the rate of strokes. This is the more so because of the desire to produce products by punch presses with increasingly higher precision.

SUMMARY OF THE INVENTION

A general object of the present invention is, therefore, to provide a punch press which does not give rise to the mentioned drawbacks and in which products having the desired precision can be produced with any tool over the entire range of the rate of strokes.

A further object is to provide a multi-stroke punch press having a control apparatus which includes an input means for inputting at an arbitrary stroke rate a value for the depth of immersion which deviates from the design characteristic curve and wherein the control apparatus is designed for producing signals that adjust the inputted value in dependence from the stroke rate and the design characteristic curve combined.

A still further object of the present invention is to provide a multi-stroke punch press having a control apparatus which includes an input means for inputting at an arbitrary stroke number a value for the feeding length which deviates from the design characteristic curve, and wherein the control apparatus is designed such for producing the signals that the inputted value is adjustable dependent from the stroke number and combinable with the design characteristic curve.

By means of a punch press designed in accordance with the invention, it is possible to produce precise punched products within the entire range of number of strokes. If—as generally known—the punch press is accelerated from a low number of strokes, e.g. 100 strokes per minute which is the setting stroke along the tool-specific design value curve up to the desired number of strokes, errors of the immersion depth at a high number of strokes are visible and can be measured at the punched product. By the input of a value as correction for the immersion depth, the error at the prevailing number of strokes can be visibly and measurably reduced. The control system bases itself onto the preset design characteristic curve. If now the number of strokes is changed again, a new design value is produced in the control apparatus. The input value is thereby changed by the apparatus and used together with the fixed design characteristic curve for the setting of the immersion depth, suitable for the new number of strokes.

The procedure with regard to changes of the design value of the feeding length are similar to the aforementioned procedures.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 2:
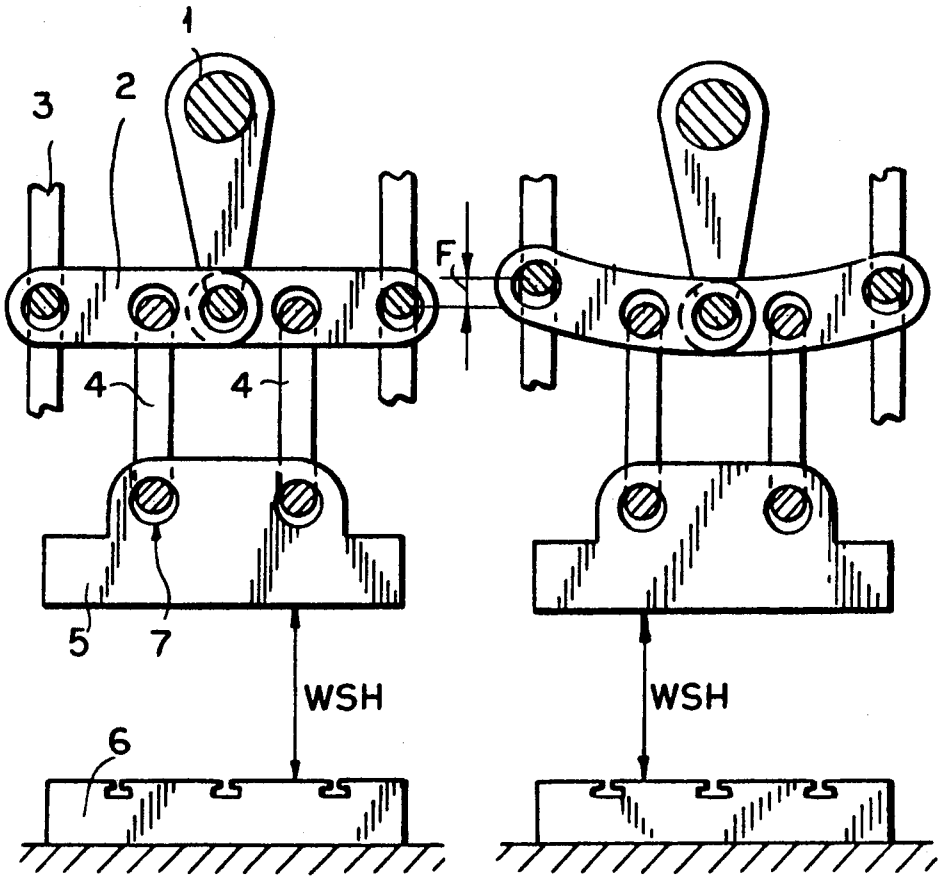
FIGS. 1 to 4 illustrate on a simplified basis the most important movable parts of a punch press.

Attention is initially drawn to FIGS. 1–4, which illustrate the most important parts of a punch press that are necessary for understanding the present invention and based on which the difficulties regarding the immersion depth will be explained here below. The most important parts of the punch press as illustrated are the crank arm 1, the lever 2, the adjustment spindle 3, the connecting rods 4, the punch 5 and the table 6. WSH signifies the so-called height of the tool closure. Furthermore, the elastic deflection F as well as the play or clearance S, respectively, are illustrated schematically and depending from the prevailing particulars of the operation.

Figure 1:
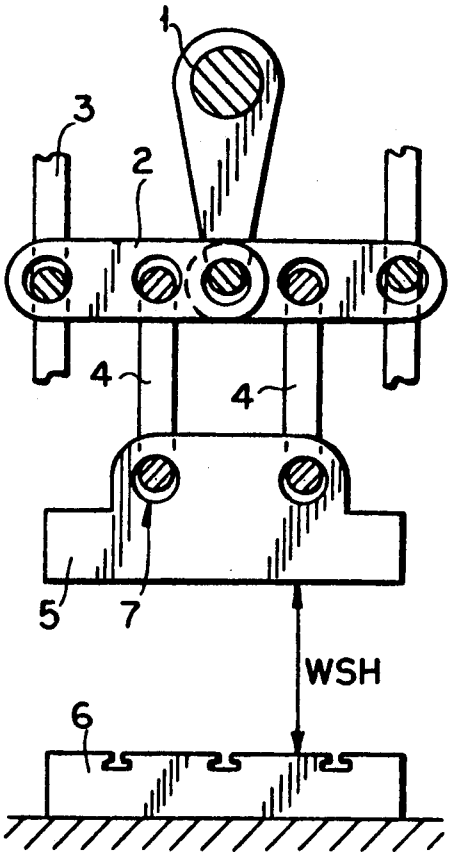

FIG. 1 now illustrates a press which is in operation at a rate of strokes of 100 strokes/min. and without any tool. The various bearings 7 are illustrated as journal bearings and the clearance present in those bearings is designed excessively large. All structural members, specifically the levers 2 act as rigid structures, are accordingly not deflected. The relative position between the trunnion and the bearing bush, i.e. the play, of the bearing, is determined merely by the punch 5, i.e. to be more precise, by its dead weight. It is now obvious that all structural members are "pulled downwards" by the punch 5. The height of the tool closure WSH corresponds to the preset design height of the tool closure.

FIG. 2 illustrates again the same punch press operating, however, at a relatively high rate of strokes, for instance at 1500 strokes/min. and again without a tool. Due to this high rate of strokes, elastic deformations of operating members are produced, the so-called dynamic deflection. This situation is illustrated schematically in FIG. 2 as a deflection of the levers 2. Now, however, the height of the tool closure WSH must be kept at a constant value because this value influences in the last instance also the immersion depth. In order to keep this height of the tool closure WSH at the illustrated dynamic deflection at a constant value, it would, accordingly, be necessary to correct the heights of the bearings by an amount that corresponds to the mentioned dynamic deflection. In other words, it would now be necessary to carry out a correction of the height by a measure that equals the measure of the dynamic deflection.

Figure 3:
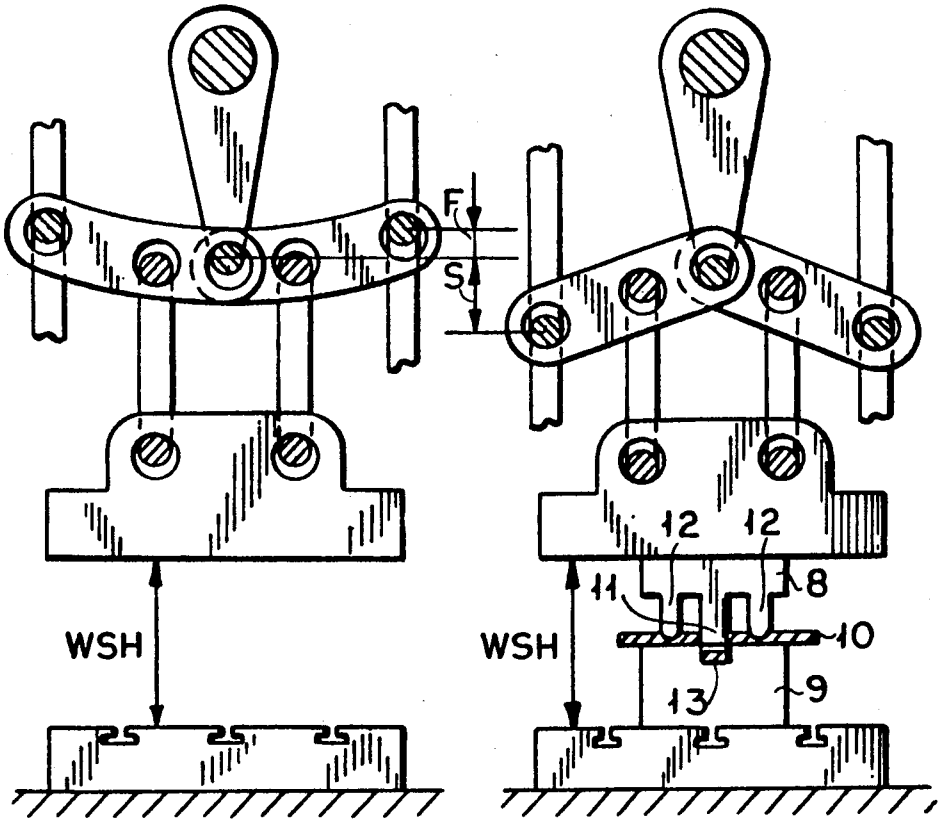

FIG. 3 illustrates the same punch press in operation at 100 strokes/min., accordingly, again the same as that of FIG. 1. Additionally, however, the upper part 8 of the tool, the lower part 9 of the tool as well as the work piece, i.e. the web 10 that is punched and embossed for producing the product, are illustrated in FIG. 3. A piece 13 of the work piece web 10 has been punched out.

Due to the low rpm of e.g. 100/min., no dynamic forces prevail in the machine in similarity to the condition of FIG. 1. However, due to the punching and embossing operation, i.e. generally due to the work carried out, forces are generated which as shown in FIG. 3, are directed upwards and result in the schematic illustrations of the individual bearings and of the position of the levers. The reasons for errors are here the clearances, specifically those of the bearings. In order now to produce just the same an impeccable punching, it will here be necessary to eliminate the entire clearances. Because here the punch is pressed "upwards", it would obviously be necessary to adjust the punch by a measure s downwards such that again the preset height of the tool closure can be maintained.

Figure 4:
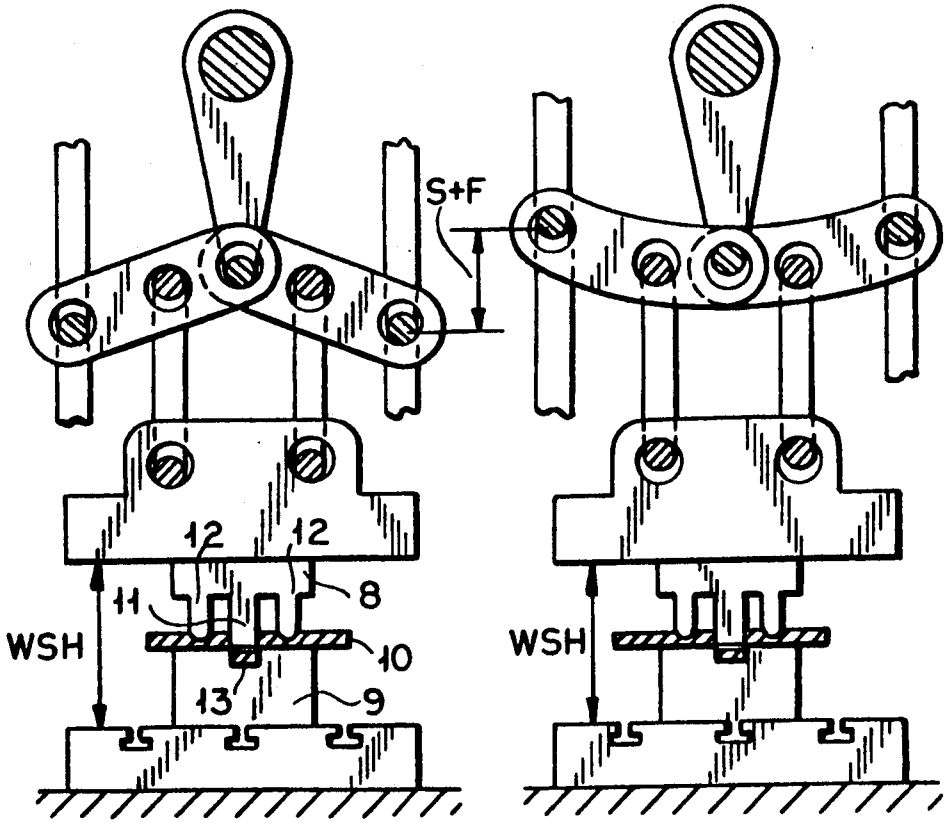

FIG. 4 illustrates the punch press at the same high number of strokes/min. as illustrated in FIG. 2. Due to the large dynamic forces (at about 300–400 strokes/min.), the clearances and the dynamic deflection are similar to FIG. 2. In order to again keep the height of the tool closure WSH at a constant value, it would be necessary to correct the immersion depth by the adjustment of the punch by a value F+S.

The above explanation and description reveals accordingly that the punch must be given different heights in dependence on the rate of strokes, the tool, and also the work piece (e.g., its metallurgical properties). It must also be noted that a measuring of the immersion depth without a punching operation leads to an imprecise changing of the height of the punch.

Figure 5:
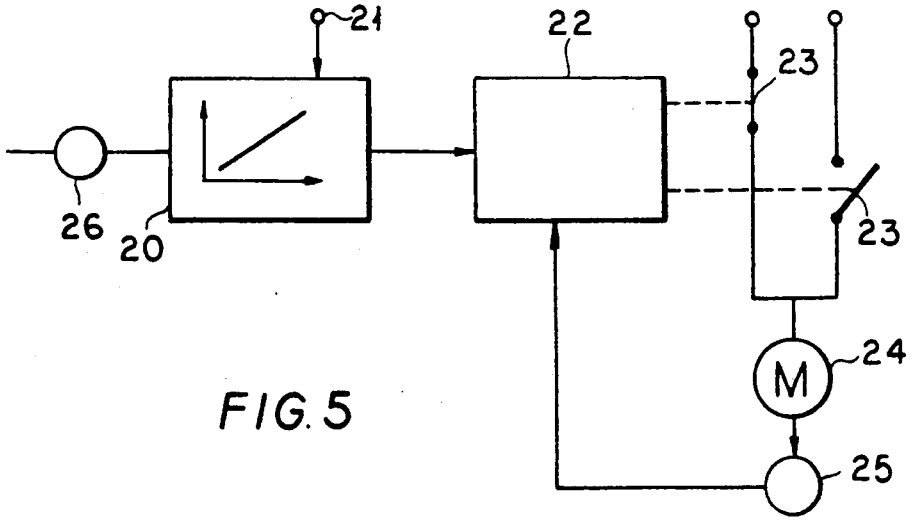
FIG. 5 illustrates a diagram of a known control apparatus.

FIG. 5 illustrates schematically a block diagram of a commonly known control apparatus, based basically on the figure of the DE-patent specification 27 31 084. The rate of strokes is fed from a corresponding sensor 26 to a first element 20, in which a design characteristic curve is stored. Such a design characteristic curve is provided for every tool used on this machine. The design characteristic curve can be programmed by an input 21 of the control apparatus. The design characteristic curve represents for instance the depth of immersion as function of the rate of strokes. In a second element 22, a comparator, the design immersion depth given by the element 20 is compared with the actual immersion depth, which is sensed by a sensor 25 at a motor 24 of the apparatus that adjusts the immersion depth. If the actual immersion depth deviates by a preset threshold value from the design immersion depth, the element 22 activates a switch 23 in order to operate the motor of the immersion depth adjusting apparatus for increasing or decreasing the height of the punch or tool, respectively. The operation of this apparatus continues until the acutal value corresponds again to the design value within the frame of the preciseness of the controlling.

Figure 6:
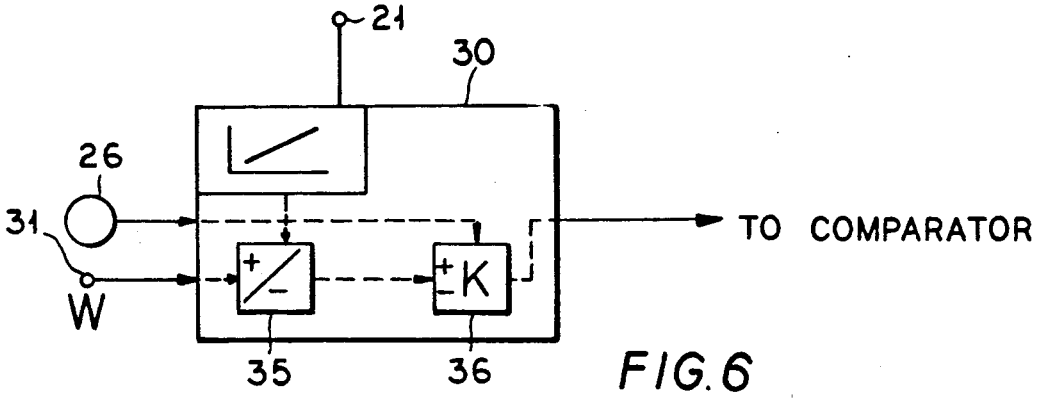
FIG. 6 illustrates a control apparatus designed in accordance with the invention.

FIG. 6 illustrates on a rough schematic basis how the control apparatus of a punch press structured in accordance with the present invention can be designed. Only one element 30 of the control apparatus is illustrated which corresponds basically to the element 20 of FIG. 5. For reasons of simplicity, the further elements of FIG. 5 in FIG. 6 are not particularly illustrated. These elements 22, 23, 24, 25 are structured in the control apparatus according to FIG. 6 basically the same as in the known control apparatus according to FIG. 5.

The element 30 also includes a tool-specific design characteristic curve of known kind, which has been programmed via the input 21. It also includes an input for the stroke rate from a signal received from a sensor 26. Now, however, another input, i.e. input means 31, is provided by means of which a value can be inputted, by which value the immersion depth is corrected by the instantaneously prevailing rate of strokes. This will now be explained more in detail based on FIG. 7, which illustrates a design characteristic curve 40 in an immersion depth/strokes rate diagram. For reasons of simplicity, this design characteristic curve is illustrated as a rectilinear line. While this is correct for a feeding apparatus, for the immersion depth, this design characteristic curve will as a rule have the shape of a parabola. The schematic design characteristic curve illustrates to which value the immersion depth is controlled to at a given prevailing rates of strokes.

Based on the previous discussion of the FIGS. 1 to 4, it is, however, obvious that the design characteristic curve can only give an imperfect representation of the complex realistic function. Correspondingly, the parts punched in accordance with this design characteristic curve can incorporate large deviations from the desired tolerance of production if the control apparatus follows the design characteristic curve 40 of the device of FIG. 5. Accordingly, the control apparatus of the punch press structured in accordance with the present invention includes an input 31 via which a value can be inputted by which the control apparatus "disconnects" itself from the design characteristic curve.

Figure 7:
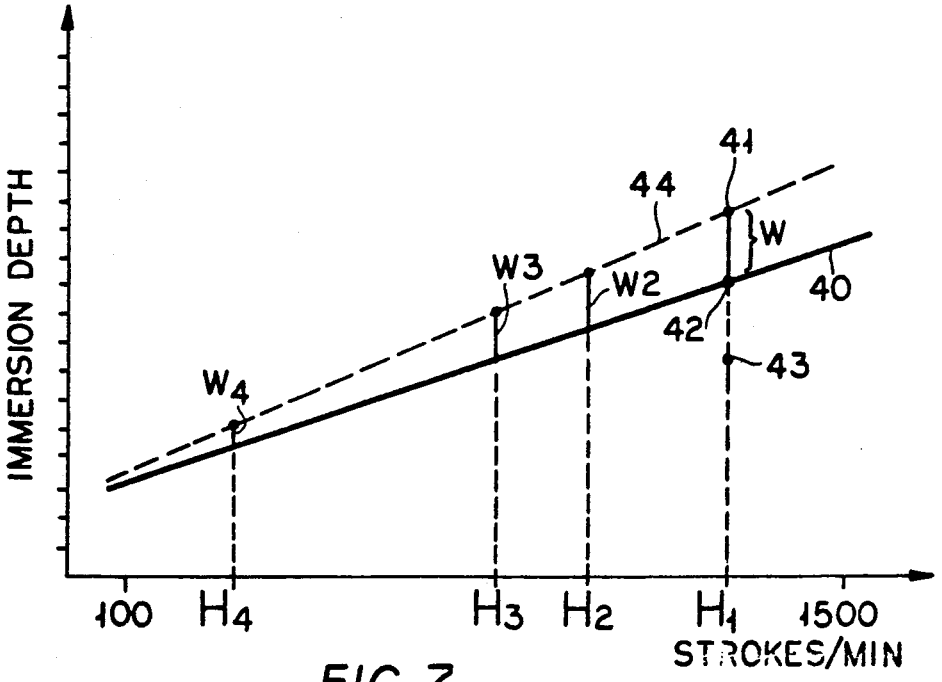
FIG. 7 illustrates a characteristic curve for illustrating the effect of the control apparatus of FIG. 6.

FIG. 7 illustrates how such is manifested in the immersion depth/strokes rate diagram. The operator of the punch press was able to determine that at a number of strokes $H_1$ an operation in accordance with the corresponding point 42 of the design characteristic curve does not lead to the desired precision of the punched product. A correction value W can now be inputted via the input 31 at the control apparatus. The punch press operates in such case at the operating point 41, which is arrived at from the design characteristic curve 40 and the inputted correction value W. The input 31 of the value W can be any of a variety of means (none shown), e.g. by of a numeric key board as digital value, by means of an adjustable resistance as analogous value, or by +/− keys in predetermined small steps. The kind of the input is dependent on the individual design of the control apparatus.

The illustrated example depicts the value W only principally; quite obviously W can be larger or smaller or can also be operative on the other side of the design characteristic curve, such that an operating point 43 would be produced. In case the precision of the products arrived at a new operating point 41 is not satisfactory, quite obviously a different value for W can be inputted.

If now the rate of strokes is changed, the value W is automatically changed by the control apparatus. This can proceed continuously such that again a continuous curve (illustrated by broken-line at curve 44) is produced between the stroke numbers $H_1$ to $H_4$, or $H_{max}$ to $H_{min}$, respectively. This can be done by forming the additional characteristic curve from the minimum value of the known design characteristic curve to the new operating point 41. It is also possible to form, however, only individual values $W_2$ to $W_4$ for stroke rates $H_2$ to $H_4$, respectively, in which case the new "operation design characteristic curve" arrived at therewith extends staggered, i.e. from the preceding point of the design characteristic curve, or is formed by a rectilinear line between the individual points.

The design characteristic curve 40 for the immersion depth extends preferably in the shape of a parabola and upon a change all parameters of such parabola are calculated anew proceeding from the value W set by an arbitrary number of strokes and a new operation design characteristic curve is formed therewith. In such case, the control apparatus is obviously preferably formed by a digital process control that makes the necessary calculations and corresponding controlling.

In FIG. 6 is, however, indicated exemplary how an inventive design of the control apparatus can be arrived at basically at small expense. The signal at the output 33 to the comparator 22 is, thereby, formed such that an adder/subtracter 35 combines the base value from the design characteristic curve with the inputted value W in order to produce the new operating point. When the rate of strokes changes, a second adder/subtracter 36 is activated to subtract from the hitherto new operating point 41 e.g. a constant K when the rate of stroke decreases or add the constant K when the rate of stroke increases.

Because as a rule the values W, i.e. or the new operating design characteristic curve, are appropriate for a given tool during a large time span, the control apparatus comprises preferably a memory in which at least one value W, and possibly the entire operating design characteristic curve and a number corresponding to the tool, may be stored. This allows now to directly recall a design characteristic curve for a tool that has been used earlier, and with which an operating had been made with such design characteristic curve, and to proceed with the operation directly based on the amended or changed curve therefor.

The above disclosure regarding the depth of immersion is also true for the length of feed. The corresponding design characteristic curve therefor can be a rectilinear line. The principle of the correcting and the means used therefor remain, however, the same. Quite obviously, it is possible to include in a punch press also only one of the corrections, i.e. either the length of feed or the immersion depth. Preferably, however, both possibilities are foreseen in one and the same punch press.

While there is shown and described a present preferred embodiment of the invention, it is to be distinctly understood that the invention is not limited thereto, but may be otherwise variously embodied and practiced within the scope of the following claims.

I claim:

1. In a multi-stroke punch press designed to operate at an adjustably variable rate of strokes and including a control apparatus having a design characteristic curve, the control apparatus producing a signal depending from the design characteristic curve for an adjusting apparatus, the adjusting apparatus being operative to set the depth of immersion of a punch of the punch press in dependence from the signal from the control apparatus while the punch press is operating, the improvement to the control apparatus, comprising:

input means for inputting into the control apparatus at a stroke rate a value that is combined with the design characteristic curve for changing the signal from the control apparatus.

2. The punch press of claim 1, wherein the control apparatus includes a storage unit in which the value for the input means is storable.

3. The punch press of claim 2, wherein the value relates to a tool for the punch.

4. The punch press of claim 2, wherein the design characteristic curve is in the form of a parabola dependent on stroke-rate parameters and the storage unit stores respective values for all of the stroke-rate parameters of the parabola.

5. In the punch press of claim 1, wherein the punch press further comprises feeding apparatus for controlling a feeding length of material to be punched and the control apparatus is also operative to produce a feeding-control signal for controlling the feeding length of the feeding apparatus depending from a second design characteristic curve of the control apparatus, the further improvement wherein the input means is further for inputting into the control apparatus a second value to deviate the feeding length of the material from that from the second design characteristic curve depending from the stroke rate.

6. In a multi-stroke press punch designed to operate at an adjustably variable rate of strokes and including a control apparatus having a design characteristic curve, the control apparatus producing a signal depending from the design characteristic curve for an adjusting apparatus, the adjusting apparatus being operative to set a feeding length of a material to be punched depending from the signal from the control apparatus while the punch press is operating, the improvement to the control apparatus, comprising:

input means for inputting into the control apparatus at a stroke rate a value that is combined with the design characteristic curve for changing the signal from the control apparatus.

7. The punch press of claim 6, wherein the control apparatus includes a storage unit in which the value for the input means is storable.

8. The punch press of claim 7, wherein the value relates to a tool for the punch.

* * * * *